US008094086B2

(12) United States Patent
Fratti et al.

(10) Patent No.: US 8,094,086 B2
(45) Date of Patent: Jan. 10, 2012

(54) ELECTRONICALLY STEERABLE ANTENNA

(75) Inventors: Roger A. Fratti, Mohnton, PA (US); Anthony J. Grewe, Fogelsville, PA (US)

(73) Assignee: Agere Systems Inc., Allentown, PA (US)

( * ) Notice: Subject to any disclaimer, the term of this patent is extended or adjusted under 35 U.S.C. 154(b) by 723 days.

(21) Appl. No.: 12/280,884

(22) PCT Filed: Aug. 29, 2007

(86) PCT No.: PCT/US2007/077077

§ 371 (c)(1),
(2), (4) Date: Aug. 27, 2008

(87) PCT Pub. No.: WO2009/029096

PCT Pub. Date: Mar. 5, 2009

(65) Prior Publication Data

US 2010/0156727 A1 Jun. 24, 2010

(51) Int. Cl.
*H01Q 3/24* (2006.01)

(52) U.S. Cl. ..... 343/876; 343/702; 343/829; 343/846; 343/833; 343/834; 343/825

(58) Field of Classification Search ..... None
See application file for complete search history.

(56) References Cited

U.S. PATENT DOCUMENTS

| | | | | |
|---|---|---|---|---|
| 5,293,172 | A | 3/1994 | Lamberty et al. | |
| 6,657,595 | B1 | 12/2003 | Phillips et al. | |
| 6,703,981 | B2 | 3/2004 | Meitzler et al. | |
| 6,876,331 | B2 * | 4/2005 | Chiang et al. | 343/702 |
| 6,885,341 | B2 | 4/2005 | Tran et al. | |
| 6,888,505 | B2 | 5/2005 | Tran | |
| 6,937,195 | B2 | 8/2005 | Fabrega-Sanchez et al. | |
| 7,102,577 | B2 | 9/2006 | Richard et al. | |
| 2003/0210203 | A1 | 11/2003 | Phillips et al. | |
| 2004/0046694 | A1 | 3/2004 | Chiang et al. | |
| 2005/0116873 | A1 | 6/2005 | Soler Castany et al. | |
| 2005/0206573 | A1 | 9/2005 | Iigusa et al. | |
| 2006/0164308 | A1 | 7/2006 | Cohen | |
| 2006/0166719 | A1 | 7/2006 | Arad et al. | |
| 2010/0156727 | A1 * | 6/2010 | Fratti et al. | 343/702 |

FOREIGN PATENT DOCUMENTS

| | | | |
|---|---|---|---|
| EP | 1503449 | | 2/2005 |
| FR | 2420855 | | 10/1979 |
| GB | 545052 | A | 5/1942 |
| WO | 02084798 | A1 | 10/2002 |
| WO | 2005078861 | A2 | 8/2005 |
| WO | PCT/US2007/077077 | | 5/2008 |

* cited by examiner

*Primary Examiner* — Trinh Dinh
(74) *Attorney, Agent, or Firm* — Ryan, Mason & Lewis, LLP

(57) ABSTRACT

An electronically steerable antenna includes at least one driven element, at least one controllable counterpoise element, and a support structure on which the driven element and the controllable counterpoise element are disposed. The controllable counterpoise element has at least one geometric characteristic which can be varied. A radiating angle of the driven element is selectively controlled, at least in part, by modifying the geometric characteristic of the at least one controllable counterpoise element. The counterpoise element may include multiple conductive segments, at least a subset of which may be adapted to be individually electrically connected together so as to modify the radiating angle of the driven, element.

21 Claims, 4 Drawing Sheets

ELECTRONICALLY STEERABLE ANTENNA

RELATED APPLICATIONS

This application is a 371 of PCT/US07/77077 filed Aug. 29, 2007, the contents of which are incorporated herein by reference.

FIELD OF THE INVENTION

The present invention relates generally to antennas, and more particularly relates to antennas providing radiation and reception diversity.

BACKGROUND OF THE INVENTION

Radio platforms are becoming increasingly complex, with multiple radios and antennas often found in a single solution. For example, solutions that require antenna radiation and reception diversity will often utilize two or more antennas, each oriented in a different plane relative to one another. For example, the Nintendo® Wii™ (trademarks of Nintendo of America Inc.) gaming console implements reception diversity using two antennas oriented in different planes.

Such solutions, however, require the use of separate antennas which take up considerable space and are thus generally undesirable. Although for products like the Wii™ there may be sufficient room in the console, small form factor devices, such as, for example, mobile phones, personal digital assistants (PDAs), wireless email devices, etc., simply cannot afford the space to accommodate multiple antennas. For example, platforms currently under development may have as many as 12 active radio solutions, each with individual corresponding antennas. Including additional antennas for MIMO (multiple-input multiple-output) applications, it becomes increasingly difficult to pack such a large quantity of antennas onto, for example, a standard FR-4 (flame resistant 4) printed circuit board (PCB) (FR-4 is a composite of a resin epoxy reinforced with a woven fiberglass mat). Another recently proposed solution involves electronically tuning an antenna using variable capacitors. Here, however, a resonant frequency of a radiating element of the antenna is changed but not a radiating angle of the antenna. Consequently, this technique cannot be used to steer an antenna.

Accordingly, there exists a need for an antenna which does not suffer from one or more of the above-noted problems exhibited by conventional antennas.

SUMMARY OF THE INVENTION

The present invention meets the above-noted need by providing, in illustrative embodiments thereof, an electronically steerable antenna and a method for electronically steering an antenna.

In accordance with one aspect of the invention, an electronically steerable antenna includes at least one driven element, at least one controllable counterpoise element, and a support structure on which the driven element and the controllable counterpoise element are disposed. The controllable counterpoise element has at least one geometric characteristic which can be varied. A radiating angle of the driven element is selectively controlled, at least in part, by modifying the geometric characteristic of the controllable counterpoise element. The counterpoise element may include multiple conductive segments, at least a subset of which may be adapted to be individually electrically connected together so as to modify the radiating angle of the driven element.

The controllable counterpoise element may also include at least one switching element connected to first and second conductive segments of the plurality of conductive segments. The switching element is operative to selectively electrically connect the first and second conductive segments together. The driven element may also be operable in one of multiple ranges of frequencies based, at least in part, on whether at least part of the counterpoise element is electrically connected to a voltage source or ground.

In accordance with another aspect of the invention, a method is disclosed for electronically steering an antenna including at least one driven element, at least one counterpoise element, and a support structure on which the driven element and the controllable counterpoise element are disposed. The method includes the step of selectively controlling a radiating angle of the at least one driven element by modifying at least one geometric characteristic of the at least one controllable counterpoise element. The controllable counterpoise element may include multiple conductive segments, wherein the step of controlling the radiating angle of the driven element includes individually electrically connecting together at least a subset of the conductive segments. Likewise, the counterpoise element may further include at least one switching element connected to first and second conductive segments of the plurality of conductive segments, wherein the step of controlling a radiating angle of the driven element includes electrically connecting the first and second conductive segments together.

In accordance with another aspect of the invention, a communication system includes a transmitter and a receiver. The transmitter and/or the receiver includes an electronically steerable antenna including at least one driven element, at least one controllable counterpoise element, and a support structure on which the driven element and the controllable counterpoise element are disposed. The controllable counterpoise element has at least one geometric characteristic which can be varied. A radiating angle of the driven element is selectively controlled, at least in part, by modifying the geometric characteristic of the controllable counterpoise element. The counterpoise element may include multiple conductive segments, at least a subset of which may be adapted to be individually electrically connected together so as to modify the radiating angle of the driven element.

These and other objects, features and advantages of the present invention will become apparent from the following detailed description of illustrative embodiments thereof, which is to be read in connection with the accompanying drawings.

DETAILED DESCRIPTION OF THE INVENTION

Aspects of the present invention will be described herein in the context of an illustrative antenna which is electronically steerable so as to obtain multiple radiation patterns therefrom. While reference may be made herein to certain device components and/or arrangements of these components, it is to be understood that the present invention is not limited to these or any particular device components and/or arrangements thereof. Rather, techniques of the invention advantageously provide an antenna capable of achieving the equivalent of a multiple-antenna solution in a reduced amount of space. Antennas incorporating the inventive techniques may comprise essentially any type of antenna, including, but not limited to, dipole antennas, patch antennas, slot antennas, multi- and single-band antennas, PIFAs (planar inverted-F antennas), non-PIFAs (non-planar inverted-F antennas), etc., as will become apparent to those skilled in the art employing the techniques set forth herein.

Figure 1:
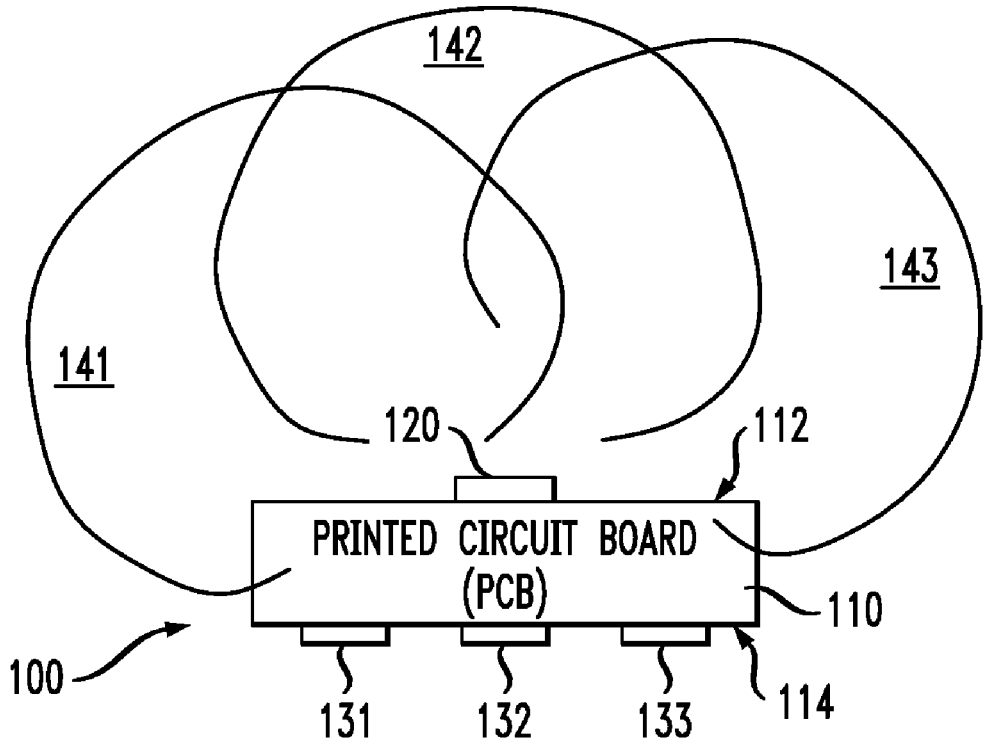
FIG. 1 is a cross-sectional view showing at least a portion of an exemplary electronically steerable antenna, formed in accordance with an embodiment of the present invention.

FIG. 1 is a cross-sectional view showing at least a portion of exemplary electronically steerable antenna 100, formed in accordance with an embodiment of the invention. Antenna 100 comprises a driven element 120, here implemented as a dipole, and first, second and third counterpoise elements 131, 132 and 133, respectively. Counterpoise elements 131, 132, 133 are shown in greater detail in FIGS. 2B and 3. Each of the counterpoise elements 131, 132, 133 may be formed on (e.g., printed on) a single-layer printed circuit board (PCB) 110, or an alternative dielectric substrate. More particularly, driven element 120 is preferably formed on an upper surface 112 of PCB 110 and the counterpoise elements 131, 132, 133 are formed on a bottom surface 114 of the PCB opposite the upper surface. The driven element 120 is electrically isolated from the counterpoise elements 131, 132, 133 via dielectric material comprised in the PCB 110. Driven elements suitable for use with the present invention may include, for example, those fabricated with metal features formed on the upper surface of the dielectric substrate, or with separate metal features at least a portion of which extend above the upper surface of the substrate. Examples of these include antennas fabricated with metal wires, as in the previously mentioned dipole antenna, or antennas stamped out of sheet metal, preformed and attached to the upper surface of the substrate, as in non-planar inverted-F antennas.

Although this embodiment depicts driven element 120 on the upper surface 112 of PCB 110 and counterpoise elements 131, 132 and 133 on the bottom surface 114 of the PCB, essentially any orientation and/or arrangement of components may be used in conjunction with the inventive techniques herein disclosed. Moreover, although antenna 100 is shown as comprising a single driven element 120 and three counterpoise elements 131, 132, 133, the invention is not limited to any specific number of driven elements and/or counterpoise elements.

By selectively varying a geometric characteristic (e.g., length, shape, etc.) of one or more counterpoise elements, such as, for example, by electrically connecting one or more of the counterpoise elements 131, 132, 133 to ground or an alternative voltage source, as will be discussed in further detail below, a radiating angle of driven element 120 can be modified accordingly so as to produce varying corresponding radiation patterns, which may be represented conceptually as patterns 141, 142 and 143, respectively. In this manner, antenna 100, in a reduced amount of space, beneficially provides the equivalent performance of multiple antennas placed in different planes relative to one another. Moreover, with the inclusion of multiple driven elements, each having a different impedance and corresponding resonance associated therewith, antenna 100 can provide diversity signal radiation and reception in different frequency bands.

Figure 2A:
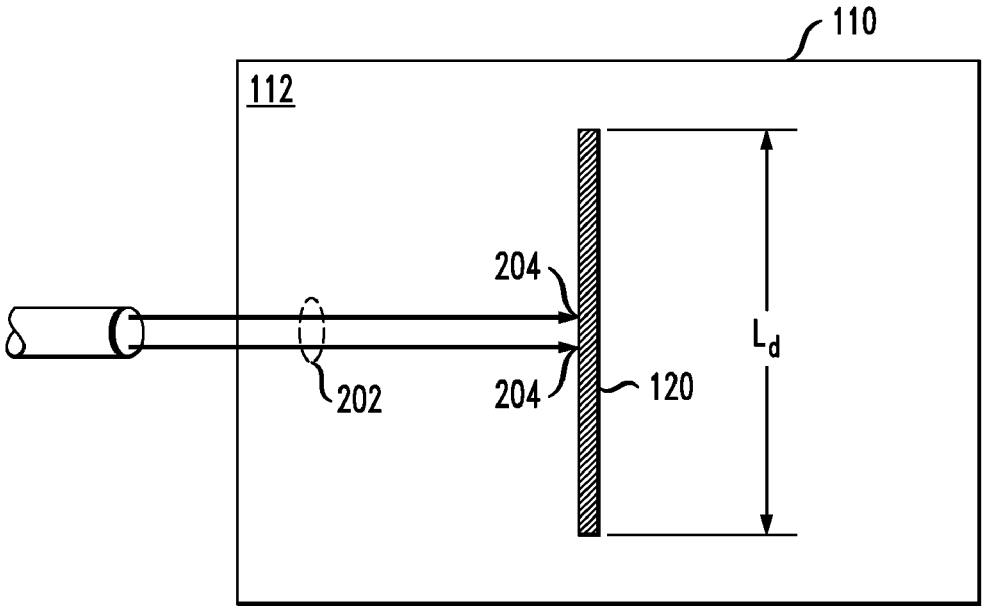
FIG. 2A is a planar view showing at least a portion of an exemplary driven element of the electronically steerable antenna depicted in FIG. 1, in accordance with an embodiment of the present invention.

FIG. 2A is a planar view of the upper surface 112 of PCB 110, illustrating at least a portion of driven element 120 of the electronically steerable antenna 100 depicted in FIG. 1, in accordance with an embodiment of the invention. Driven element 120 preferably comprises a conductive material, such as, for example, copper, aluminum, conductive ink, etc. It is to be appreciated that, although a single driven element is shown, an antenna comprising a plurality of driven elements is similarly contemplated. In the case of a dipole implementation, as illustrated, a transmission line 202, such as, for example, 75-ohm feedline, may be used to convey signals radiated by the antenna and/or signals received from the antenna. Transmission line 202 is connected to driven element 120 at one or more feed points 204 that are ideally centered along a length, $L_d$, of the driven element. This arrangement is often referred to as a center-fed dipole. Other feed point configurations are similarly contemplated. For instance, in the case of an end-fed dipole configuration, the transmission line may be connected to the driven element at opposite ends of the driven element.

Figure 2B:
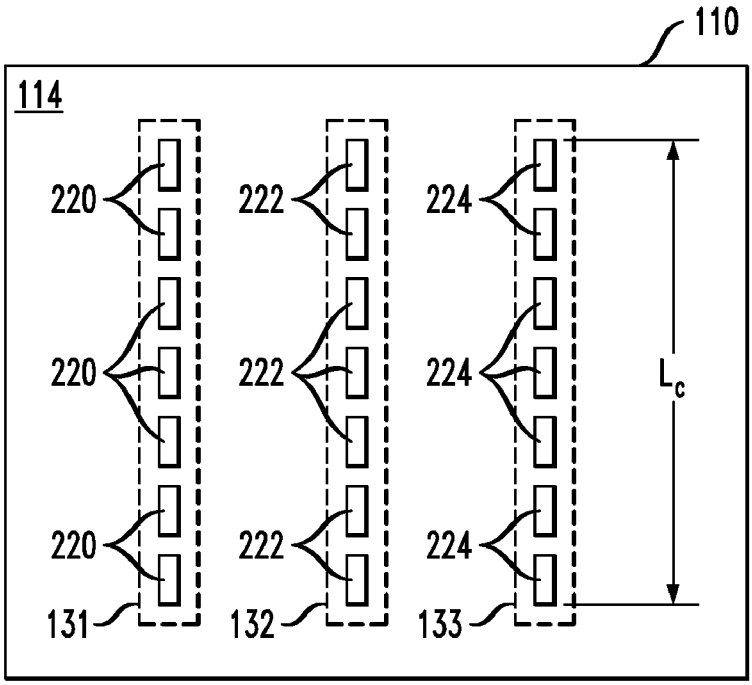
FIG. 2B is a planar view showing at least a portion of exemplary counterpoise elements of the electronically steerable antenna depicted in FIG. 1, in accordance with an embodiment of the present invention.

FIG. 2B is a planar view of the bottom surface 114 of PCB 110, illustrating at least a portion of exemplary counterpoise elements 131, 132, 133 of the electronically steerable antenna 100 depicted in FIG. 1, in accordance with an embodiment of the invention. Although a single-sided PCB is shown, a multilayer PCB may also be used. When using a PCB having multiple layers, each layer may include one or more counterpoise elements. As apparent from the figure, each of the counterpoise elements 131, 132, 133 includes a plurality of conductive segments. Specifically, counterpoise element 131 comprises conductive segments 220, counterpoise element 132 comprises conductive segments 222, and counterpoise element 133 comprises conductive segments 224. An effective length, $L_c$, of each of the counterpoise elements will be a function of the number of conductive segments connected together in series.

It is to be appreciated that, although three counterpoise elements are shown, an antenna comprising more counterpoise elements (e.g., four) or less counterpoise elements (e.g., two) is similarly contemplated. Additionally, two or more counterpoise elements may be electrically connected together to form a new counterpoise element having an effective length that is equal to a sum of the respective lengths of the combined counterpoise elements. An antenna configuration including only one counterpoise element is similarly contemplated. In this configuration, the antenna may exhibit a non-directional radiation pattern (e.g., isotropic pattern) when the conductive segments of the counterpoise element are not connected together, and may exhibit a directional radiation pattern when the respective conductive segments are connected together.

Figure 3:
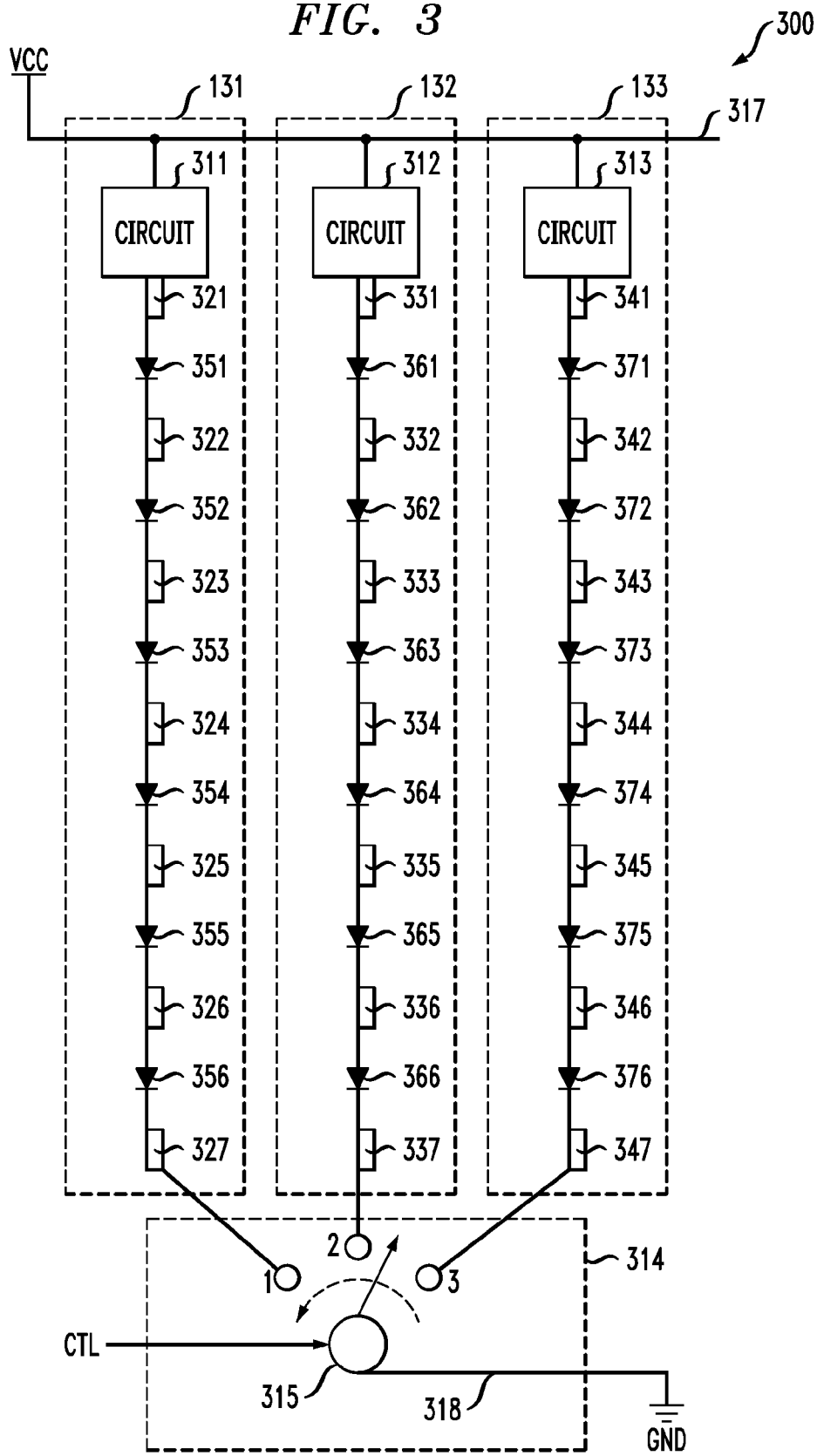
FIG. 3 is a block diagram depicting an exemplary implementation of the counterpoise elements shown in FIG. 2B, in accordance with an embodiment of the present invention.

FIG. 3 is a block diagram depicting an exemplary arrangement 300 of counterpoise elements 131, 132, 133 of the steerable antenna 100 shown in FIG. 1, in accordance with an embodiment of the present invention. As previously stated, each counterpoise element preferably includes a plurality of conductive segments. It is to be understood that the invention is not limited to any particular number and/or shape of the conductive segments. The respective conductive segments are interconnected with diodes, or alternative switching elements (e.g., field-effect transistors). Preferably, each counterpoise element is divided into a sufficient number of conductive segments such that the individual segments are sized small enough to be essentially transparent with respect to the driven element when unconnected. Moreover, although the conductive segments are shown as being of equal size and shape relative to one another, the segments need not be of the same size or shape.

The term "transparent" as used herein is intended to imply that there is no significant modification of the radiating angle of the driven element. When a plurality of conductive segments associated with a given counterpoise element are connected together in series, the given counterpoise element preferably becomes non-transparent to the driven element, so that a radiating angle of the driven element is varied according to an effective length, or other geometric characteristic of the counterpoise element, and/or a location of the counterpoise element relative to the driven element.

More particularly, first counterpoise element 131 preferably includes a plurality of conductive segments 321, 322, 323, 324, 325, 326 and 327, and a plurality of interconnecting diodes 351, 352, 353, 354, 355 and 356. A first terminal of segment 321 is connected to an anode of diode 351, a cathode of diode 351 is connected to a first terminal of segment 322, a second terminal of segment 322 is connected to an anode of diode 352, a cathode of diode 352 is connected to a first terminal of segment 323, a second terminal of segment 323 is connected to an anode of diode 353, a cathode of diode 353 is connected to a first terminal of segment 324, a second terminal of segment 324 is connected to an anode of diode 354, a cathode of diode 354 is connected to a first terminal of segment 325, a second terminal of segment 325 is connected to an anode of diode 355, a cathode of diode 355 is connected to a first terminal of segment 326, a second terminal of segment 326 is connected to an anode of diode 356, and a cathode of diode 356 is connected to a first terminal of segment 327.

Likewise, second counterpoise element 132 preferably includes a plurality of conductive segments 331, 332, 333, 334, 335, 336 and 337, and a plurality of interconnecting diodes 361, 362, 363, 364, 365 and 366. A first terminal of segment 331 is connected to an anode of diode 361, a cathode of diode 361 is connected to a first terminal of segment 332, a second terminal of segment 332 is connected to an anode of diode 362, a cathode of diode 362 is connected to a first terminal of segment 333, a second terminal of segment 333 is connected to an anode of diode 363, a cathode of diode 363 is connected to a first terminal of segment 334, a second terminal of segment 334 is connected to an anode of diode 364, a cathode of diode 364 is connected to a first terminal of segment 335, a second terminal of segment 335 is connected to an anode of diode 365, a cathode of diode 365 is connected to a first terminal of segment 336, a second terminal of segment 336 is connected to an anode of diode 366, and a cathode of diode 366 is connected to a first terminal of segment 337.

Third counterpoise element 133 preferably includes a plurality of conductive segments 341, 342, 343, 344, 345, 346 and 347, and a plurality of interconnecting diodes 371, 372, 373, 374, 375 and 376. A first terminal of segment 341 is connected to an anode of diode 371, a cathode of diode 371 is connected to a first terminal of segment 342, a second terminal of segment 342 is connected to an anode of diode 372, a cathode of diode 372 is connected to a first terminal of segment 343, a second terminal of segment 343 is connected to an anode of diode 373, a cathode of diode 373 is connected to a first terminal of segment 344, a second terminal of segment 344 is connected to an anode of diode 374, a cathode of diode 374 is connected to a first terminal of segment 345, a second terminal of segment 345 is connected to an anode of diode 375, a cathode of diode 375 is connected to a first terminal of segment 346, a second terminal of segment 346 is connected to an anode of diode 376, and a cathode of diode 376 is connected to a first terminal of segment 347.

Counterpoise elements 131, 132 and 133 are preferably connected at a first end to a voltage source, which may be VCC (e.g., about 3.0 volts) via corresponding circuits 311, 312 and 313, respectively. In accordance with one embodiment of the invention, each of circuits 311, 312 and 313 comprises an inductor (e.g., spiral inductor), or other inductive element. Specifically, a first terminal of each of first, second and third inductors in circuits 311, 312 and 313, respectively, connects to VCC, or an alternative voltage source, via a first source line 317, a second terminal of the first inductor in circuit 311 is connected to a second terminal of conductive segment 321, a second terminal of the second inductor in circuit 312 is connected to a second terminal of conductive segment 331, and a second terminal of the third inductor in circuit 313 is connected to a second terminal of conductive segment 341. The inductors in circuits 311, 312 and 313 are preferably of low impedance (e.g., less than one ohm) in the respective frequency ranges of intended use. While resistors may also be employed in place of the inductors, by using inductors to connect the respective counterpoise elements to voltage supply line 317, an effective impedance of the counterpoise elements, and thus a radiating angle of the antenna, may be varied as a function of the frequency of operation of the antenna.

In another embodiment of the invention, one or more of circuits 311, 312 and 313 may comprise a current source for supplying a prescribed current to a corresponding counterpoise element connected thereto. This current may be used to forward-bias the respective diodes in a given counterpoise element so as to electrically connect the conductive segments in the given counterpoise element together in series.

Each counterpoise element 131, 132, 133 can be selectively switched in, either individually or in combination with one or more other counterpoise elements, to thereby modify the radiating angle of antenna 100 (see FIG. 1), via a control circuit 314. Control circuit 314 may be described conceptually as including a switch 315 having a common pole connected to ground, or an alternative voltage source, via a second source line 318, and three terminals, namely, 1, 2 and 3, connected to each of counterpoise elements 131, 132 and 133, respectively. It is to be appreciated that essentially any voltages can be applied to first and second source lines 317 and 318, respectively, as long as the difference in voltage potential between the first and second source lines is at least equal to a sum of a threshold voltage of each of the series-connected diodes in the respective counterpoise elements and not greater than a breakdown voltage of the diodes. At least one control signal, CTL, supplied to control circuit 314 may be used to select which one of the counterpoise elements is connected in the antenna at any given time. Control circuit 314 may be implemented using, for example, a multiplexer or an alternative switching arrangement (transmission gates, etc.), as will become apparent to those skilled in the art from a reading of the description set forth herein.

When connected to second source line 318 via control circuit 314, a voltage (e.g., VCC) is applied across a given counterpoise element which preferably causes the diodes in the given counterpoise element to become forward-biased and turn on. Preferably, the diodes in the respective counterpoise elements 131, 132, 133 have a relatively low forward bias voltage associated therewith. For example, Schottky diodes and zero-bias detector diodes have a forward bias voltage (e.g., threshold voltage) of less than about 0.2 volt compared to a forward bias voltage of about 0.6 volt for common P-N junction diodes. Using diodes with a low forward bias voltage will enable operation of the counterpoise elements in low voltage supply applications (e.g., about 2.0 volts).

When the diodes in a given counterpoise element are turned on, they switch from a substantially high-resistance state (e.g., greater than about one megohm) to a substantially low-resistance state (e.g., less than about one ohm), and thereby electrically connect the conductive segments in the given counterpoise element together to create a larger, electrically non-transparent counterpoise element substantially equal in length to a sum of the respective lengths of the individual segments. Likewise, when the diodes in the given counterpoise element are turned off, the corresponding individual conductive segments in the counterpoise element become electrically isolated from one another. As previously explained, these individual conductive segments are preferably sized to be electrically small in comparison to the driven element of the antenna and are therefore essentially have no significant effect on the driven element.

By way of example only and without loss of generality, consider the case where control circuit 314 is configured to connect counterpoise element 132 to ground line 318, as indicative of switch position 2. In this scenario, diodes 351, 352, 353, 354, 355 and 356 in counterpoise element 131 will be turned off, thereby effectively electrically isolating individual conductive segments 321, 322, 323, 324, 325, 326 and 327 from one another. Likewise, diodes 371, 372, 373, 374, 375 and 376 in counterpoise element 133 will be turned off, thereby effectively electrically isolating individual conductive segments 341, 342, 343, 344, 345, 346 and 347 from one another. Therefore, counterpoise element 131 and 133 will be electrically transparent to the driven element 120 of steerable antenna 100 (see FIG. 1). Concurrently, supply voltage VCC is applied across counterpoise element 132 and thus diodes 361, 362, 363, 364, 365 and 366 in counterpoise element 132 will be turned on, thereby electrically connecting individual conductive segments 331, 332, 333, 334, 335, 336 and 337 together in series. Counterpoise element 132 will therefore be electrically non-transparent to the driven element and thus illustrative antenna radiation pattern 142 will result. In a similar manner, when either of counterpoise elements 131 or 133 is switched in, one of illustrative antenna radiation patterns 141 or 143, respectively, will result.

Finer control of the radiating angle of the driven element or elements may be obtained, for example, by electrically connecting various subsets of conductive segments within one or more of the counterpoise elements, since a shape (e.g., a length) of a given counterpoise element may be varied as a function of the number of conductive segments that are connected together in the given counterpoise element. Additionally, other antenna radiation patterns can be obtained by electrically connecting more than one of counterpoise elements 131, 132 and 133 together. It is further contemplated that an antenna utilizing the teachings of the invention may be time-multiplexed, so that the radiating angle of the driven element is changed during prescribed intervals of time by dynamically reconfiguring the counterpoise elements so as to produce a desired radiation pattern during any given time interval.

Antennas incorporating techniques of embodiments of the present invention may include any number and type of counterpoise elements, including, but not limited to, for example, ground radials, radial stubs, composite squares and/or composite rectangles. Although the illustrative embodiment described herein includes counterpoise elements comprising diode switching elements interspersed between segmented conductors, electrical connection of the counterpoise elements may be controlled by a variety of means, including, for example but without limitation, switches, diodes, transistors, and/or multiplexers.

At least a portion of the techniques of the present invention may be implemented in an integrated circuit. In forming integrated circuits, identical die are typically fabricated in a repeated pattern on a surface of a semiconductor wafer. Each die includes a device described herein, and may include other structures and/or circuits. The individual die are cut or diced from the wafer, then packaged as an integrated circuit. One skilled in the art would know how to dice wafers and package die to produce integrated circuits. Integrated circuits so manufactured are considered part of this invention.

An integrated circuit in accordance with the present invention can be employed in any applications and/or electronic systems which require antenna radiation, as in the case of, for example, systems comprising a transmitter or transceiver, and/or reception diversity, as in the case of, for example, systems comprising a receiver or transceiver. Suitable systems for implementing techniques of the invention may include, without limitation, personal computers, communication networks, mobile communication devices (e.g., cellular phones), gaming systems, wireless interface devices, etc. Systems incorporating such integrated circuits are considered part of this invention. Given the teachings of the invention provided herein, one of ordinary skill in the art will be able to contemplate other implementations and applications of the techniques of the invention.

Figure 4:
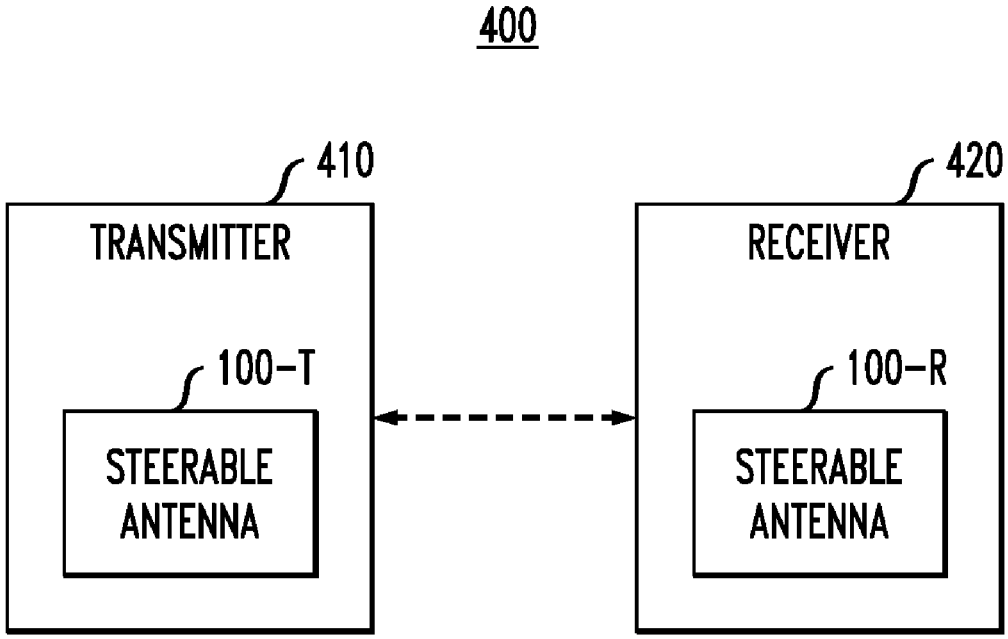
FIG. 4 is a block diagram depicting an exemplary communication system incorporating the electronically steerable antenna depicted in FIG. 1, in accordance with an embodiment of the present invention.

FIG. 4 is a block diagram depicting an exemplary communication system 400 in accordance with an embodiment of the present invention. Communication system 400 includes transmitter 410 and receiver 420. Transmitter 410 and receiver 420 include respective electronically steerable antennas 100-T and 100-R of the type depicted in FIG. 1. As would be understood by one skilled in the art, transmitter 410 and/or receiver 420 could be implemented using a transceiver.

Although illustrative embodiments of the present invention have been described herein with reference to the accompanying drawings, it is to be understood that the invention is not limited to those precise embodiments, and that various other changes and modifications may be made therein by one skilled in the art without departing from the scope of the appended claims.

What is claimed is:

1. An electronically steerable antenna, comprising:

at least one driven element;

at least one controllable counterpoise element; and a support structure on which the at least one driven element and the at least one controllable counterpoise element are disposed;

wherein a given controllable counterpoise element comprises a plurality of conductive segments and a plurality of individually activatable switching elements, each of the switching elements being connected between two adjacent conductive segments of the plurality of conductive segments; and wherein a radiating angle of the at least one driven element is selectively controllable, at least in part, by activating one or more of the switching elements so as to electrically connect at least some of the conductive segments together thereby modifying at least one geometric characteristic of the given controllable counterpoise element.

2. The antenna of claim 1, wherein the at least one geometric characteristic comprises at least one of a shape and a length of the at least one controllable counterpoise element.

3. The antenna of claim 1, wherein the at least one geometric characteristic is selectively variable as a function of at least one control signal.

4. The antenna of claim 1, wherein the at least one counterpoise element is selectively connectable to ground.

5. The antenna of claim 1, wherein the switching elements comprise respective diodes.

6. The antenna of claim 1, wherein each of the plurality of conductive segments, when electrically isolated from another of the plurality of conductive segments, is configured to be substantially electrically transparent with respect to the at least one driven element.

7. The antenna of claim 1, wherein the at least one driven element is operable in one of a plurality of ranges of frequencies based at least in part on whether at least part of the controllable counterpoise element is electrically connected to one of a voltage source and ground.

8. The antenna of claim 1, wherein the at least one driven element comprises at least one of a dipole antenna, a patch antenna, a slot antenna, a multi-band antenna, a single-band antenna, a planar inverted-F antenna, and a non-planar inverted-F antenna.

9. The antenna of claim 1, wherein the support structure is one of a dielectric substrate and a printed circuit board.

10. The antenna of claim 9, wherein at least one of the at least one driven element and the at least one controllable counterpoise element is printed onto the dielectric substrate.

11. The antenna of claim 1, further comprising a control circuit connected to the given controllable counterpoise element, the control circuit being operative to receive at least one control signal supplied thereto and to selectively vary the at least one geometric characteristic of the given controllable counterpoise element as a function of the at least one control signal.

12. The antenna of claim 11, wherein the control circuit comprises a multiplexer.

13. An integrated circuit comprising the electronically steerable antenna of claim 1.

14. The antenna of claim 1, wherein the plurality of switching elements are individually activatable as a function of at least one control signal.

15. The antenna of claim 1, further comprising a control circuit connected to the given controllable counterpoise element, the control circuit being operative to receive at least one control signal supplied thereto and to activate the one or more of the plurality of switching elements as a function of the at least one control signal.

16. The antenna of claim 15, wherein the control circuit comprises a multiplexer.

17. The antenna of claim 1, wherein the given controllable counterpoise element further comprises an inductor coupled between a voltage source and at least one of the plurality of conductive segments.

18. A method of electronically steering an antenna, the antenna comprising at least one driven element, at least one controllable counterpoise element and a support structure on which the at least one driven element and the at least one controllable counterpoise element are disposed, a given controllable counterpoise element comprising a plurality of conductive segments and a plurality of individually activatable switching elements, each of the switching elements being connected between two adjacent conductive segments of the plurality of conductive segments, the method comprising the step of:

selectively controlling a radiating angle of the at least one driven element by activating one or more of the switching elements so as to electrically connect at least some of the plurality of conductive segments together thereby modifying at least one geometric characteristic of the given controllable counterpoise element.

19. The method of claim 18, further comprising the step of configuring the at least one driven element for operation in one of a plurality of ranges of frequencies by electrically connecting at least part of the at least one controllable counterpoise element to one of a voltage source and ground.

20. The method of claim 18, further comprising the step of printing at least one of the at least one driven element and the at least controllable counterpoise element onto the support structure.

21. A communication system, comprising:

a transmitter; and a receiver;

wherein at least one of the transmitter and the receiver comprises an electronically steerable antenna, the electronically steerable antenna comprising:

at least one driven element;

at least one controllable counterpoise element; and a support structure on which the at least one driven element and the at least one controllable counterpoise element are disposed;

wherein a given controllable counterpoise element comprises a plurality of conductive segments and a plurality of individually activatable switching elements, each of the switching elements being connected between two adjacent conductive segments of the plurality of conductive segments; and wherein a radiating angle of the at least one driven element is selectively controllable, at least in part, by activating one or more of the switching elements so as to electrically connect at least some of the conductive segments together thereby modifying at least one geometric characteristic of the given controllable counterpoise element.

* * * * *